US005410884A

United States Patent [19]

Fukue et al.

[11] Patent Number: 5,410,884

[45] Date of Patent: May 2, 1995

[54] COMBUSTOR FOR GAS TURBINES WITH DIVERGING PILOT NOZZLE CONE

[75] Inventors: Ichiro Fukue; Shigemi Mandai; Katsunori Tanaka; Hitoshi Kawabata; Nobuo Sato; Hiroyuki Nishida; Tetsuo Gora, all of Takasago, Japan

[73] Assignee: Mitsubishi Jukogyo Kabushiki Kaisha, Tokyo, Japan

[21] Appl. No.: 137,343

[22] Filed: Oct. 18, 1993

[30] Foreign Application Priority Data

Oct. 19, 1992 [JP] Japan ..... 4-304442
Feb. 12, 1993 [JP] Japan ..... 5-047227

[51] Int. Cl.[6] ..... F02C 1/00
[52] U.S. Cl. ..... 60/747; 60/749
[58] Field of Search ..... 60/746, 737, 748, 742, 60/733, 740, 747, 39.06, 749; 239/405, 406

[56] References Cited

U.S. PATENT DOCUMENTS 2,385,833 10/1945 Nahigyan ..... 60/39.06
3,349,826 10/1967 Poole et al. ..... 239/406
4,982,570 1/1991 Waslo et al. ..... 60/737

FOREIGN PATENT DOCUMENTS 0095788 12/1983 European Pat. Off. .
0108361 5/1984 European Pat. Off. .
0269824 6/1988 European Pat. Off. .
0455487 11/1991 European Pat. Off. .
0564184 10/1993 European Pat. Off. .
654122 6/1951 United Kingdom ..... 60/746

*Primary Examiner*—Richard A. Bertsch
*Assistant Examiner*—William J. Wicker
*Attorney, Agent, or Firm*—Wenderoth, Lind & Ponack

[57] ABSTRACT

A gas turbine combustor suppresses the generation of NOx by mixing a fuel and air homogeneously. A pilot nozzle is provided at the center of the gas turbine combustor. A plurality of main nozzles surround the pilot nozzle. A diverging cone projects from the vicinity of the injection port of the pilot nozzle such that the flame from the main nozzles is sustained by the pilot nozzle and NOx is suppressed. The main nozzles can be provided upstream of the injection port of the pilot nozzle in which case an annular premixing nozzle having a throttled exit end is disposed downstream of the main nozzles. The main nozzle may also be in the form of a fuel nozzle having a plurality of tubes, a gaseous fuel being injected through one of the tubes, and liquid fuel being injected into the annular premixing nozzle through the other of the tubes so that the liquid fuel is atomized to mix the fuel and air homogeneously.

6 Claims, 9 Drawing Sheets

COMBUSTOR FOR GAS TURBINES WITH DIVERGING PILOT NOZZLE CONE

BACKGROUND OF THE INVENTION

1. Field of the Invention

The present invention relates to a combustor capable of reducing NOx in a gas turbine.

2. Description of the Relevant Art

The entrance temperature of a gas turbine has been elevated in recent years to obtain higher efficiencies in cogenerator plants which tends to result in an increase in the generation of NOx. Serious demands for lower NOx content in the exhaust gases have thus been raised and met by various proposals.

One of the factors influencing-the amount of NOx produced is the combustion temperature, and it is known that the lower the combustion temperature the less NOx is generated. At present, therefore, a two-stage combustion system has been developed to effect efficient combustion and to suppress the rise of the combustion temperature and accordingly the generation of NOx. In this two-stage combustion system, diffusion combustion is performed at the first stage for obtaining ignition and flame stability, and premixed combustion is performed at the second stage to obtain a high NOx reducing effect.

FIG. 10 shows a premixed type of combustor for a gas turbine in the prior art. In FIG. 10, a gas turbine premixed type of combustor 01 has a pilot nozzle 02 at its center. A plurality of cylindrical main (or premixing) nozzles 03 are disposed along a common circle around the pilot nozzle 02. In this arrangement, each main nozzle 03 has its leading end located substantially in the same plane as that of the leading end of the pilot nozzle 02. Incidentally, reference numeral 04 designates a combustion chamber, and numeral 05 designates swirl vanes.

As described above, as the entrance temperature of the gas turbine rises, the more NOx is emitted to the atmosphere. This raises serious demands for a system producing a lower amount of NOx in the exhaust gases. Because the rise in gas temperature increases the amount of the air burnt, the mixing of the fuel and air is an important factor which has been investigated in reducing the NOx content of the exhaust gas.

In the premixed type of combustor of the prior art shown in FIG. 10, however, the premixing nozzles collectively constitute a cylindrical structure with the aim of achieving a compact combustor structure. Thus, the mixing of the fuel and air does not always sufficiently limit the generation of NOx.

SUMMARY OF THE INVENTION

An object of the present invention is to solve the aforementioned problems of the prior art by providing a gas turbine combustor which minimizes the generation of NOx by promoting the mixing of the fuel and air.

In order to achieve the above object, the present invention provides a gas turbine combustor comprising: a combustion chamber; a pilot nozzle arranged at the center of the gas turbine combustor; a plurality of main nozzles arranged around the pilot nozzle and each forming a primary mixing chamber; a diverging cone projecting from the vicinity of the injection port of said pilot nozzle toward the combustion chamber; and a secondary mixing chamber between the primary mixing chamber and the end of the cone (the combustion chamber).

The plurality of main nozzles may be provided upstream of the injection port of the pilot nozzle, wherein the secondary mixing chamber is an annular premixing nozzle having a throttled exit end.

Further, each of the main nozzles may be in the form of a fuel nozzle having at least two tubes, one for injecting gaseous fuel within the primary mixing wall of the main nozzle and the other for atomizing a liquid fuel at the exit end of the annular premixing nozzle.

The diverging cone projects from the vicinity of the injection port of the pilot nozzle so that the zone of the circulating flow of the fuel downstream of the pilot nozzle is comparatively large to enhance the ability of the main flame to be maintained by the pilot flame (flame stability). As a result, the combustion is stable even at a low pilot injection rate producing a correspondingly low amount of NOx.

Further, the fuel and air are mixed in individual doses in the plurality of main nozzles arranged around (and preferably upstream of) the pilot nozzle, and the mixtures then join and are mixed in the secondary mixing chamber (the annular premixing nozzle) so that the air and fuel are further homogeneously mixed to improve their combustion in the combustion chamber to reduce the generation of NOx. Moreover, the homogeneous mixture is introduced at a high velocity into the combustion chamber through the throttled exit end of the annular premixing nozzle so that flash-back can be prevented while enhancing flame stability.

With the fuel nozzle of the invention, the gaseous fuel is injected into the main nozzles, and the liquid fuel is sprayed at the exit end of the annular premixing nozzle, so that the fine liquid vapors are evaporated and premixed with the gaseous fuel. As a result, the liquid fuel is homogeneously gasified to ensure combustion having a low NOx content.

DETAILED DESCRIPTION OF THE PREFERRED EMBODIMENTS

Figure 1:
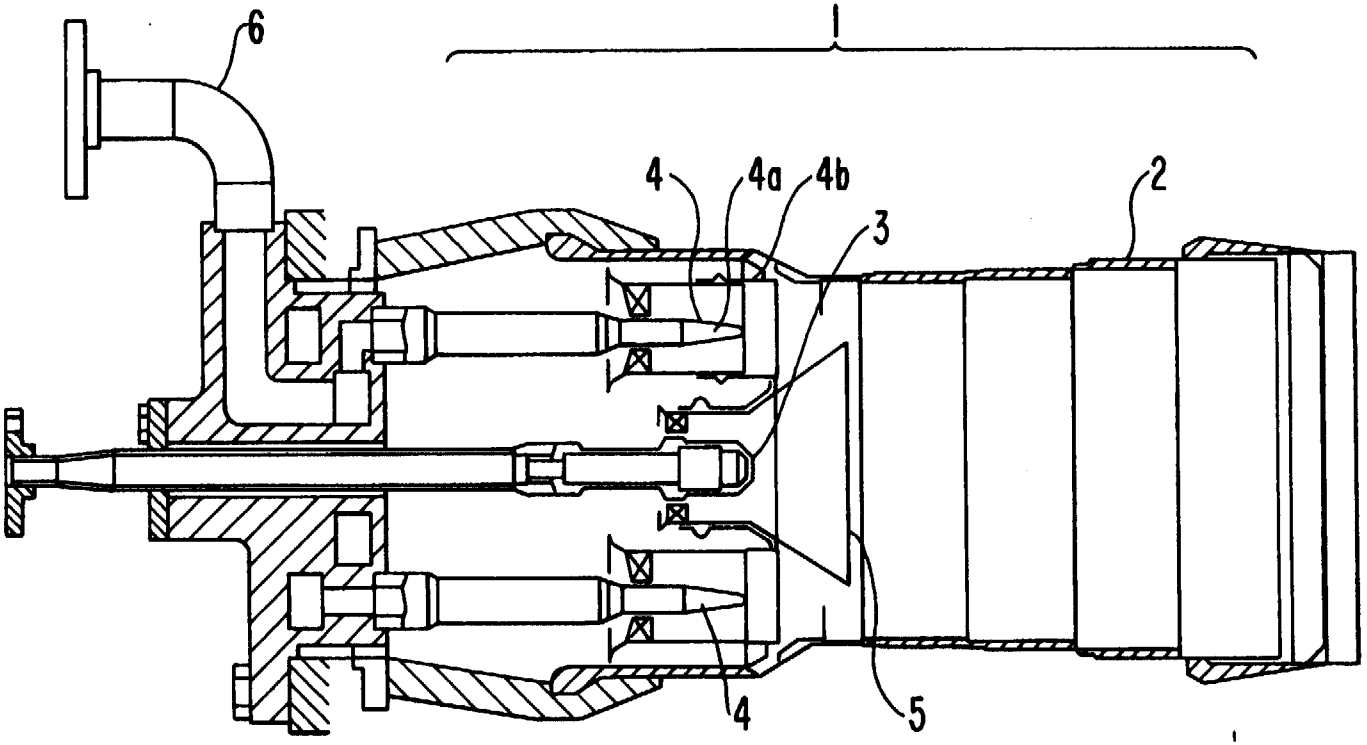
FIG. 1 is a longitudinal sectional view of a first embodiment of a combustor according to the present invention.

A first embodiment of the present invention will be described in the following with reference to FIG. 1. In FIG. 1, a combustor 1 has, at its center, a pilot nozzle 3 directed toward the combustion zone of an inner cylinder 2. The pilot nozzle 3 is surrounded by a plurality of main nozzles 4. These main nozzles 4 are arranged such that the ends of their injection ports 4*a* lie in generally the same plane as that in which the end of the injection port of the pilot nozzle 3 lies. Reference 4*b* designates a primary mixing chamber wall of the main nozzle.

A diverging cone 5 projects from the injection port of the pilot nozzle 3. The diverging cone 5 is also directed toward the combustion zone of the inner cylinder 2, to expand the zone of the circulating flow of a fuel injected from the pilot nozzle 3. As a result, a stable combustion can be established even at a low injection rate of the pilot fuel, to reduce the emission of NOx from the pilot nozzle 3. Incidentally, reference numeral 6 designates the fuel pipe of the main nozzles 4.

A second embodiment of the present invention will be described with reference to FIGS. 2 to 6.

Figure 2:
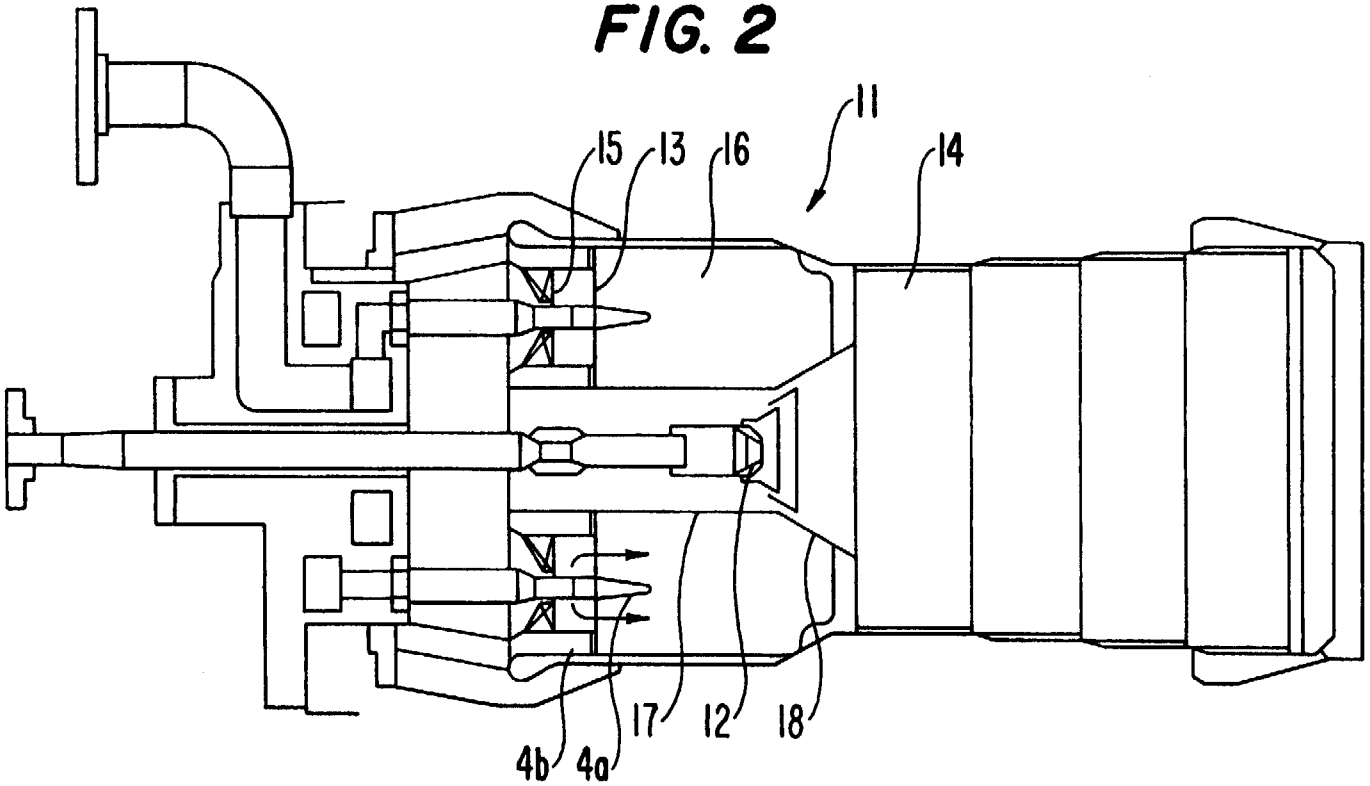
FIG. 2 is a longitudinal sectional view of a second embodiment of the present invention.

In FIG. 2, a premixed type of gas turbine combustor 11 has a pilot nozzle 12 at the center thereof. The combustor 11 also includes a plurality of cylindrical main (or premixed) nozzles 13 disposed around the pilot nozzle 12 in a common circle. These main nozzles 13 are shorter than the main nozzles 03 of the prior art shown in FIG. 10 and are located upstream of the pilot nozzle 12. Each of the main nozzles 13 has swirl vanes 15. An annular premixing nozzle 16 extends downstream of the cylindrical main nozzles 13. As a result, the insides of each of the cylindrical main nozzles 13 provide primary mixing chambers for the fuel and air, and the inside of the annular premixing nozzle provides a secondary mixing chamber. The secondary mixing chamber has an inner circumference defined by an inner cylinder 17, which has its exit end 18 diverged or expanded radially outward toward a downstream combustion chamber 14 so that the premixture flow passage is converged or throttled.

The operation of the second embodiment of the combustor will be described. The fuel and air are mixed at a first stage in the cylindrical primary mixing chambers of the main nozzles 13, and these preliminary mixtures join one another and are subjected to a second-stage mixing in the annular premixing nozzle 16 so that the fuel and air are sufficiently mixed into a homogeneous mixture. Thus, the combustion in the combustion chamber 14 generates a comparatively low amount of NOx.

On the other hand, the flow velocity of the mixture is accelerated when it flows into the combustion chamber 14 due to the fact that the secondary mixture chamber is throttled by the diverging exit end 18 of the inner cylinder 17 defining the inner circumference of the annular premixing nozzle (secondary mixing chamber) 16. As a result, flash-back can be prevented, and the circulating flow can be formed without fail at the diverging exit end 18 of the inner cylinder 17 to ensure flame stability.

Figure 3:
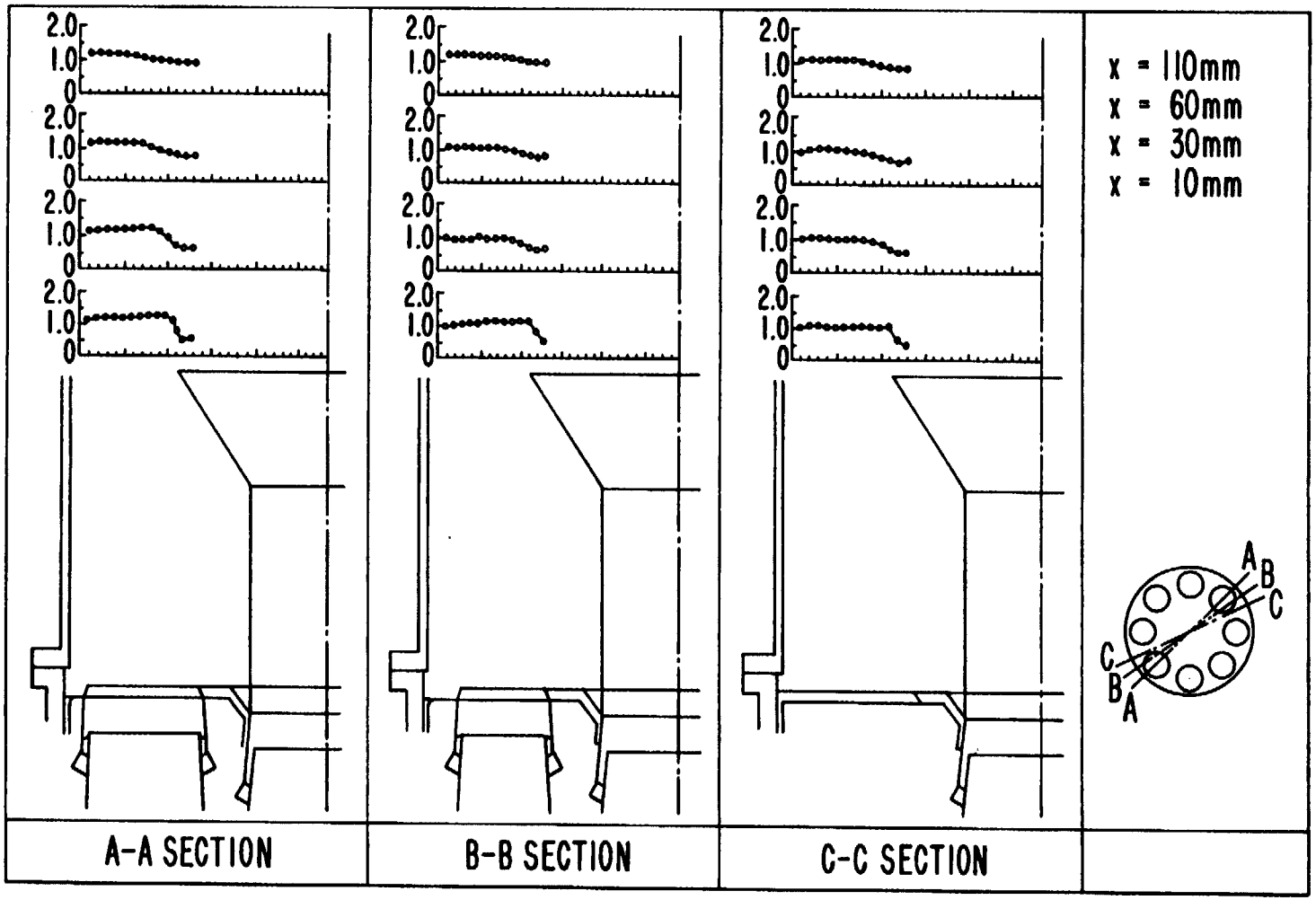
FIG. 3 is a diagram illustrating the fuel concentration distribution at the nozzle exit of the second embodiment of the combustor.
Figure 4:
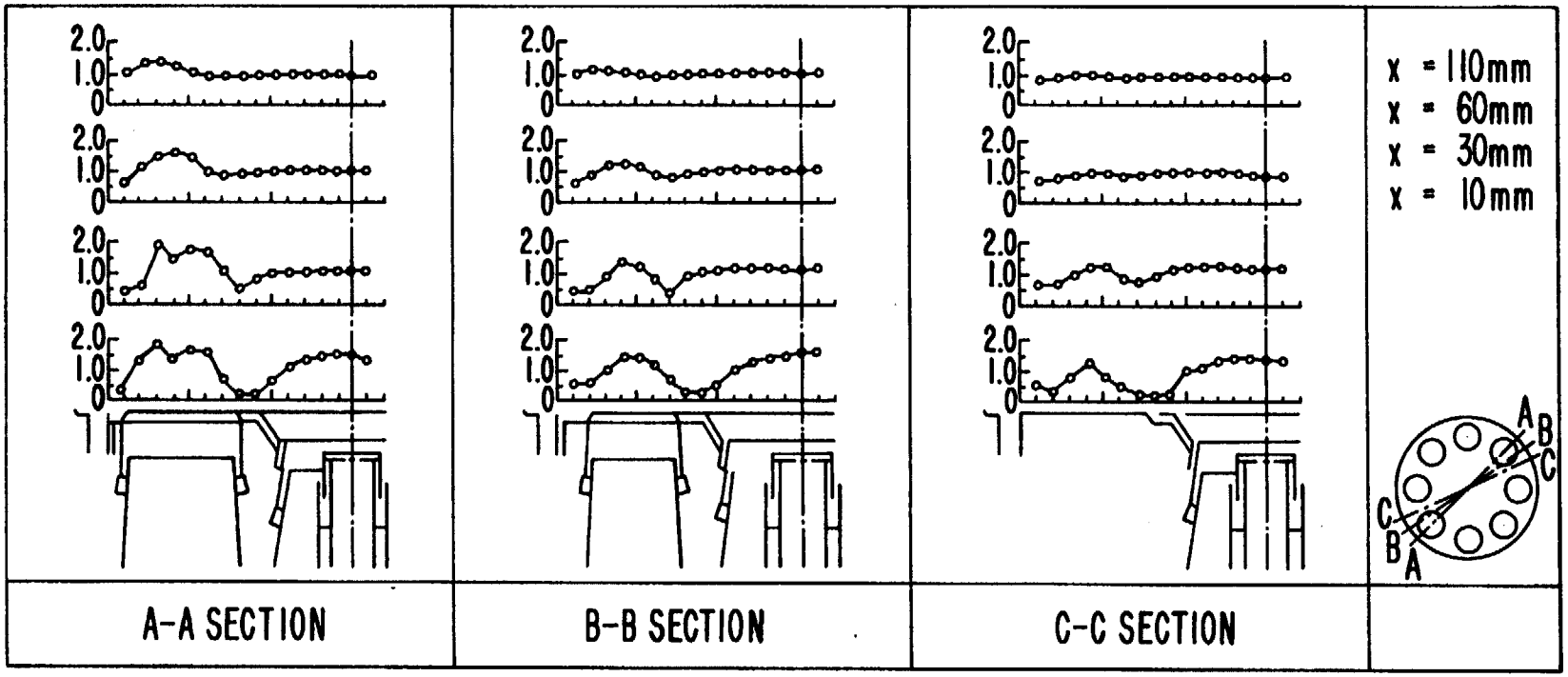
FIG. 4 (PRIOR ART)
FIG. 4 is a diagram illustrating the fuel concentration distribution at the nozzle exit of the premixed type of combustor of the prior art.
Figure 10:
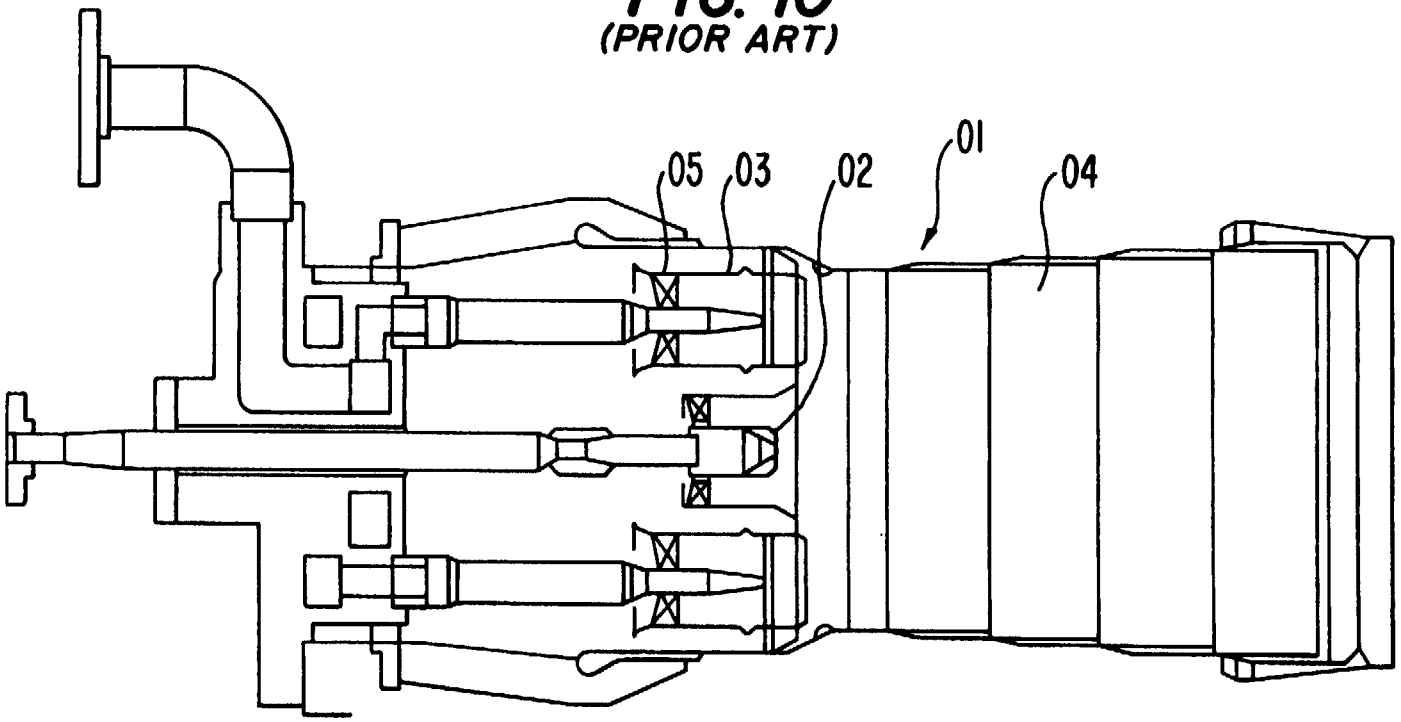
FIG. 10 (PRIOR ART)
FIG. 10 is a longitudinal sectional view of a premixed type of combustor of a gas turbine of the prior art.

FIG. 3 is a diagram plotting fuel concentration distributions at the nozzle exit of the premixed type of combustor according to the present invention, as shown in FIG. 2, and FIG. 4 is a diagram plotting fuel concentration distributions at the nozzle exit of the premixed type of combustor of the prior art, as shown in FIG. 10. In FIGS. 3 and 4, moreover, letter x designates the distances from the confluences at which the mixture from the pilot nozzle and the mixtures from the main nozzles join one another. As can be seen by comparing those figures, the premixed type of combustor of the prior art has a wide-ranging fuel concentration distribution at the nozzle exit. In the premixed type of combustor according to the present invention, on the contrary, the mixtures from the main nozzles have substantially homogeneous fuel concentrations at the confluence.

Figure 5:
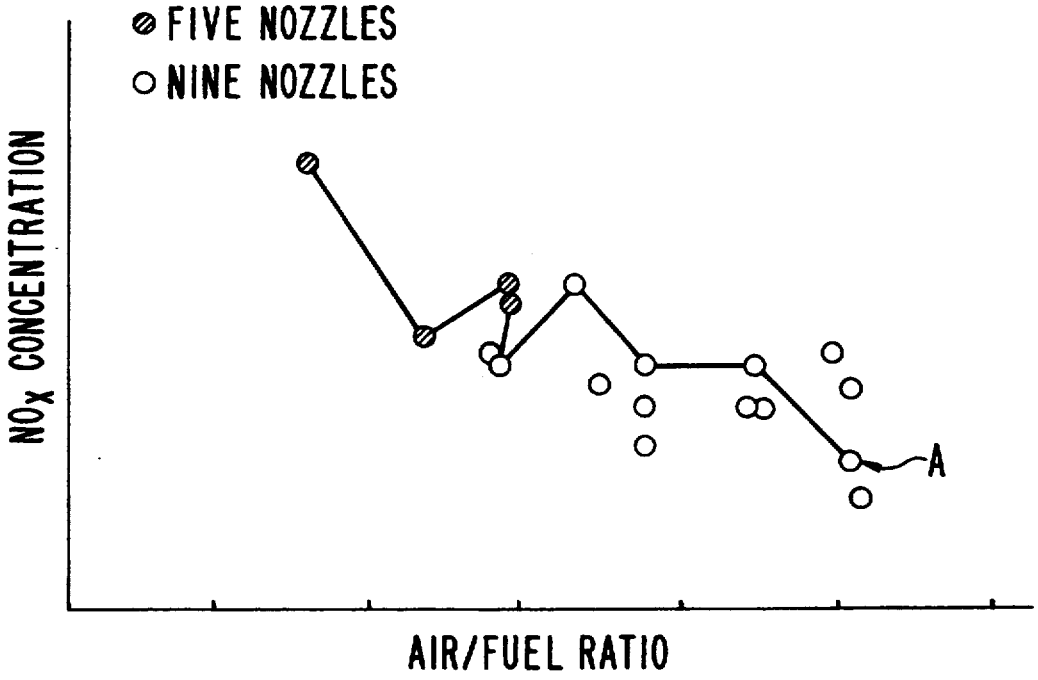
FIG. 5 is a graph plotting NOx concentrations from combustion tests of the second embodiment of the premixed type of combustor.
Figure 6:
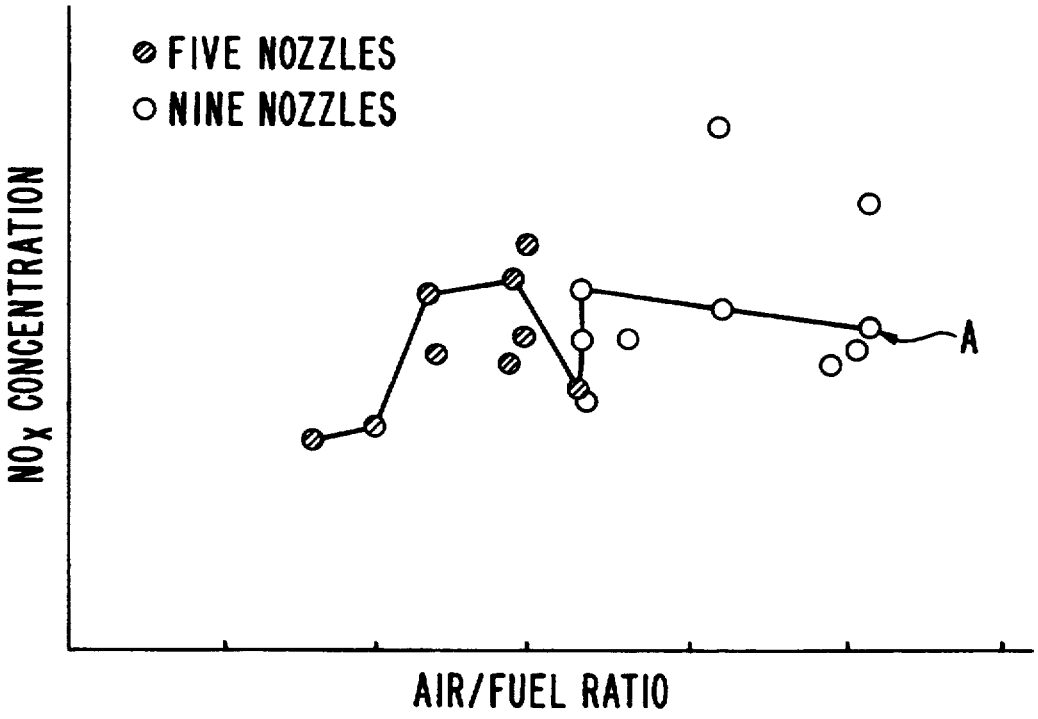
FIG. 6 (PRIOR ART)
FIG. 6 is a graph plotting the NOx concentrations from combustion tests of the premixed type of combustor of the prior art.

On the other hand, FIG. 5 is a graph plotting the NOx concentrations which were obtained from combustion experiments carried out on the premixed type of combustor according to the present invention, as shown in FIG. 2, and FIG. 6 is a graph plotting the NOx concentrations which are obtained from combustion experiments carried out on the premixed type of combustor of the prior art, as shown in FIG. 10. In FIGS. 5 and 6, moreover, the solid curves join points which were determined as yielding the best results including with respect to CO concentrations. The comparison of these figures will reveal that the present invention can reduce the NOx concentrations to one half of that in the prior art under the rated load conditions, as indicated at points A.

A third embodiment of a dual-fuel burning premixed type of combustor according to the present invention will be described with reference to FIG. 7. In this embodiment, the pilot nozzle 12, the main (or premixing nozzles) 13, the swirl vanes 15, the annular premixing nozzle 16, the inner cylinder 17, and the exit end of the inner cylinder are all of the same structures as those of the foregoing second embodiment.

A plurality of fuel nozzles 24 for feeding individual jets of fuel within the primary mixing walls of the main nozzles 13 and into the annular premixing nozzle 16 extend through the main nozzles 13 and the annular premixing nozzle 16. Leading ends of the fuel nozzles 24 located at the exit end of the premixing nozzle 16 are directed downstream of the premixed combustor 21.

These fuel nozzles 24 each comprise two tubes, one of which is fed with gaseous fuel (to constitute part of a main nozzle) whereas the other is fed with liquid fuel. That is, the gaseous fuel is injected through an injection part of the first tube just downstream of the swirl vanes 15 within primary mixing walls of the cylindrical main nozzles 13 so that it is preliminarily mixed with the swirls by the swirl vanes 15 and then injected downstream. The resultant mixture jets atomize the fine liquid fuel vapors, which are sucked and vaporized from the second tube of the fuel nozzles 24 at the exit end of the annular premixing nozzle 16, into a finer and more homogeneous mixture. In short, the fine fuel vapors are preliminarily evaporated and mixed sufficiently with the gaseous fuel so that they are completely burned whereby the resulting combusted fuel has a low NOx concentration.

Figure 7:
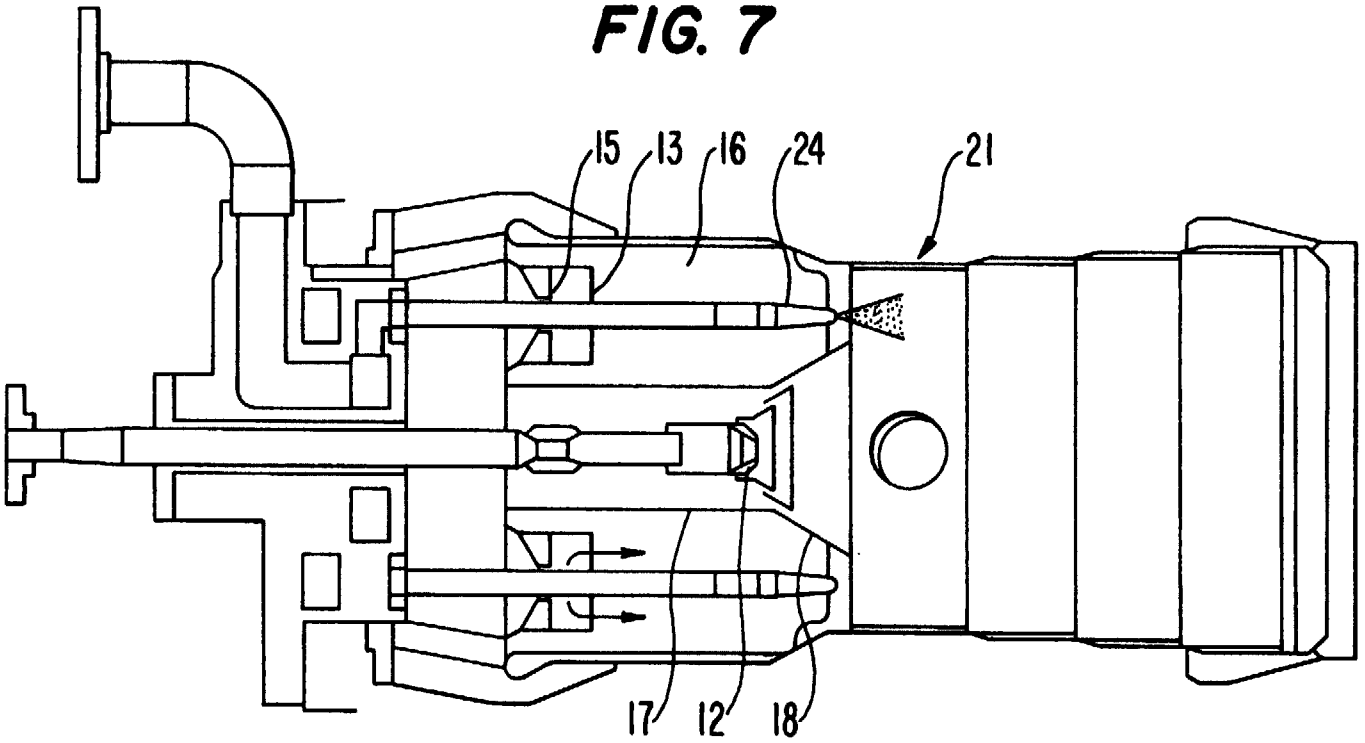
FIG. 7 is a longitudinal sectional view of a third embodiment of the present invention.
Figure 8:
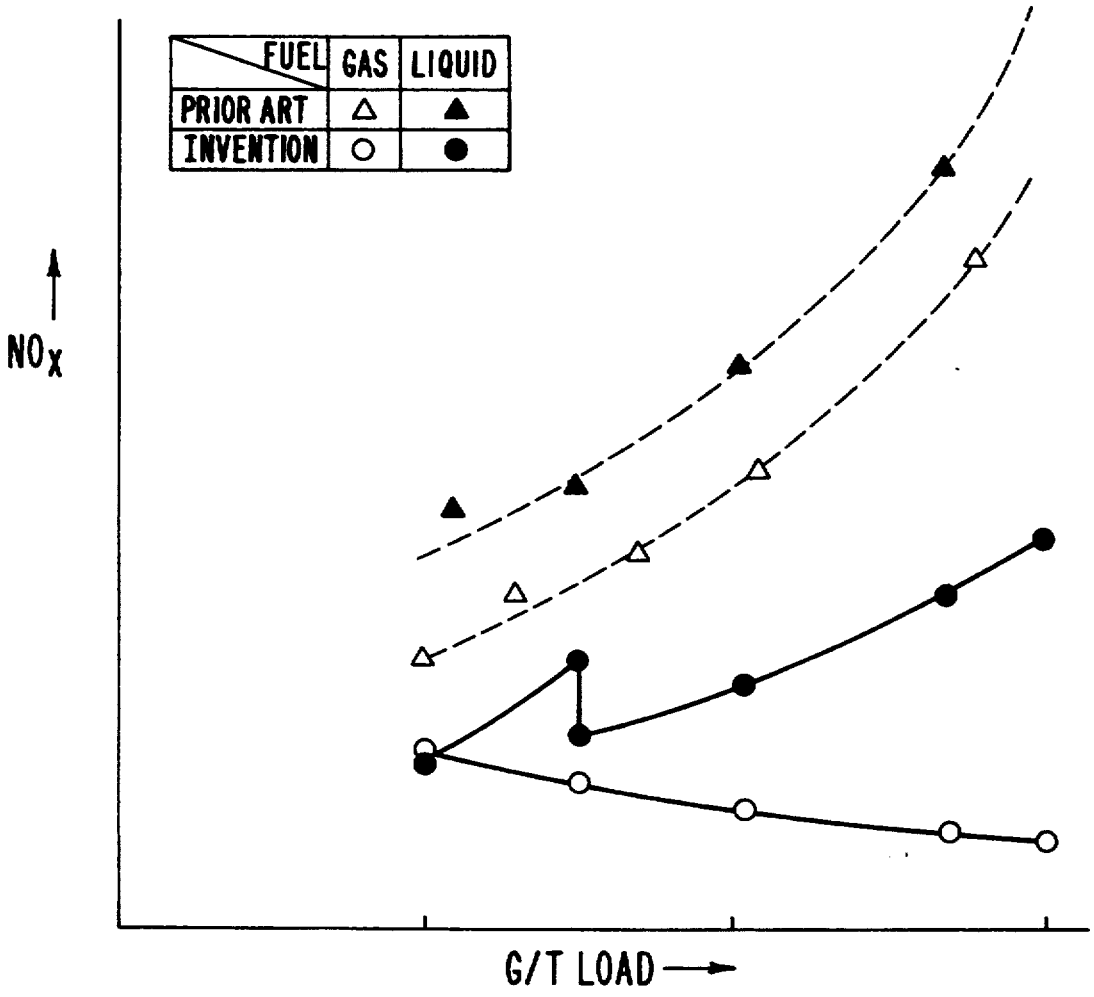
FIG. 8 is a graph comparing NOx emissions of the third embodiment and the prior art.

FIG. 8 compares the generation of NOx of the combusted fuel generated in the third embodiment of the dual-fuel burning premixed type of combustor according to the present invention, as shown in FIG. 7, and that generated in the premixed type combustor of the prior art, as shown in FIG. 10. The generation of NOx from the gaseous fuel an the liquid fuel are plotted when the individual combustors are run under predetermined loads. For the liquid fuel (or oil), it is found that the combustor of the present invention always generates combusted fuel having a NOx concentration as low as about 50% of that of the combusted fuel generated in the conventional combustor. For the gaseous fuel, on the other hand, the combustor of the present invention generates combusted fuel having about 50% of the NOx content of the prior art under a light load, and about 20% under a high load.

Figures 9A, 9B:
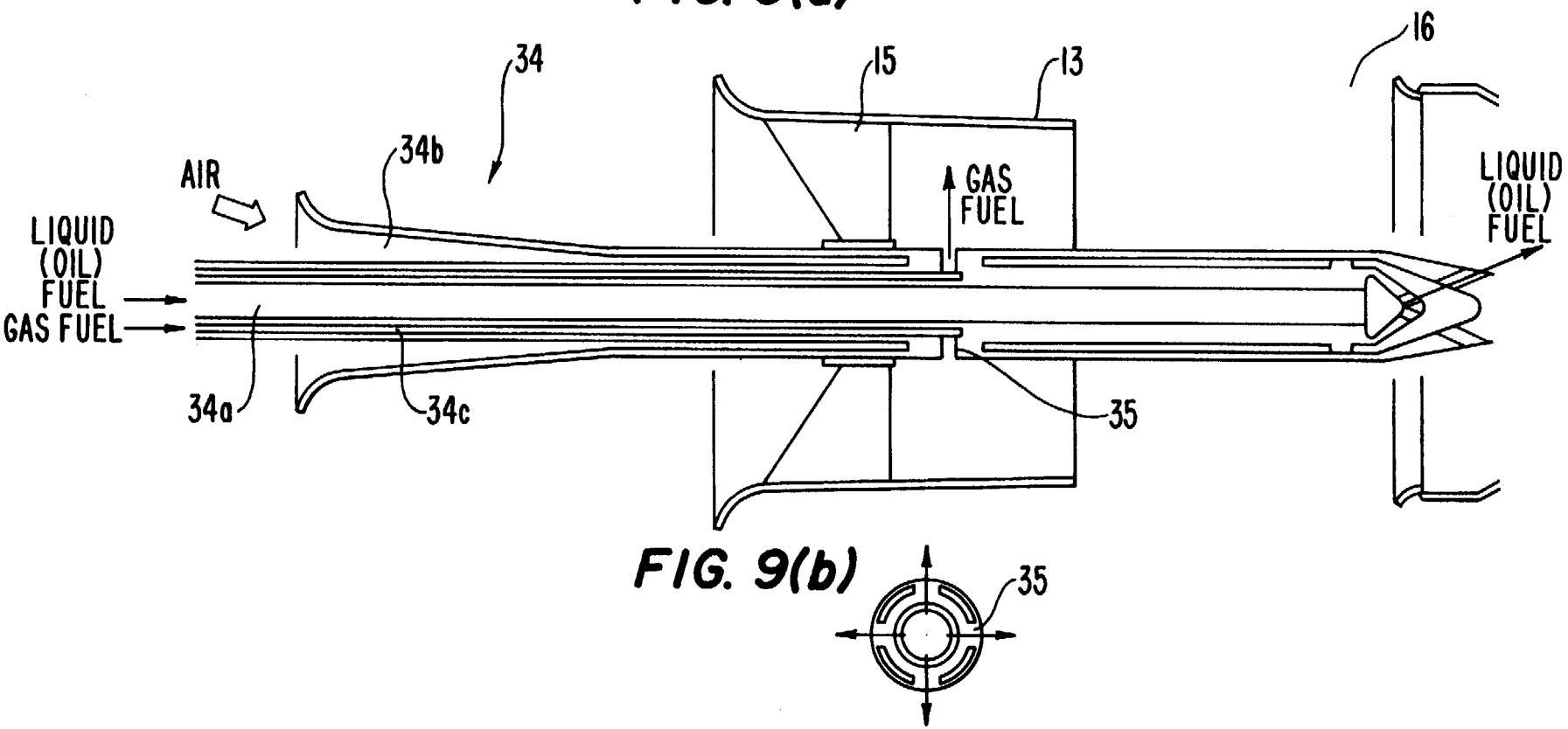
FIG. 9(*a*) is a longitudinal sectional view of a fuel nozzle of a fourth embodiment of the present invention, and FIG. 9(*b*) is a cross-sectional view of the same.

A fourth embodiment of the present invention will be described with reference to FIGS. 9(*a*), 9(*b*). In the present embodiment, the dual fuel nozzles 24 of the foregoing third embodiment are replaced by triple fuel nozzles 34, as will be described in the following. Specifically, each triple fuel nozzle 34 is constructed of three tubes: the innermost one providing a liquid fuel passage 34*a* for the liquid fuel, the outermost one providing an air passage 34*b* for the air, and the intermediate one providing a gaseous fuel passage 34*c* for the gaseous fuel. The intermediate gaseous fuel passage 34*c* extends downstream of the swirl vanes 15 of the main nozzle 13 so that the gaseous fuel may be injected into the main nozzle 13 through radially formed tubular passages 35 constituting an injection port of the main nozzle 13. On the other hand, the innermost liquid fuel passage 34*a* and the outermost air passage 34*b* extend together to the vicinity of the injection port of the fuel nozzle 34.

In the present embodiment, the gaseous fuel is injected from just behind the swirl vanes 15, as indicated by arrow, into the cylindrical main nozzle 13 and is premixed with the air flows by the swirl vanes 15 so that this preliminary mixture is injected into the annular premixing nozzle 16 located downstream thereof. On the other hand, the liquid (or oil) fuel is injected by the two-fluid or air/oil nozzle for atomizing with the air, so as to promote the mixing, i.e., to make the injected vapors finer and more homogeneous.

The liquid fuel passage 34*a* and the air passage 34*b* extend to the vicinity of the injection port of the fuel nozzle 34 so that the liquid fuel is atomized at the exit end of the fuel nozzle 34, which is disposed at the injection port of the annular premixing nozzle 16, by the air flow injected from the air passage 34*b*. At this time, the air flowing from the air passage 34*b* acts to promote the vaporization of the liquid fuel and atomize the fuel vapors. The gaseous fuel premixed in the cylindrical main nozzles 13 is injected to promote the atomization of the atomized liquid fuel so that the fuel is homogenized to ensure a complete fuel combustion and low NOx emission.

According to the aforementioned third and fourth embodiments, the fuels can be prevented from overheating by the multiplex fuel passages. According to the fourth embodiment, moreover, this fuel cooling effect is enhanced by the air passage disposed at the outermost side.

What is claimed is:

1. A gas turbine combustor comprising: a combustion chamber; a pilot nozzle disposed on the axial centerline of the gas turbine combustor upstream of said combustion chamber, said pilot nozzle having an injection port; a cone projecting from the vicinity of the injection port of said pilot nozzle, the cone having a diverged base end adjacent the combustion chamber; a plurality of main nozzles disposed around said pilot nozzle, each of said main nozzles having a fuel injection portion defining an injection port and a respective primary mixing chamber wall surrounding the fuel injection portion to form a primary mixing chamber in the main nozzle; and a secondary mixing chamber, located between the primary mixing chamber wall of each of said main nozzles and said end of the cone, in which air and a fuel/air mixture from said main nozzles are mixed before passing to the combustion chamber, said secondary chamber being delimited and throttled by said end of the cone.

2. A gas turbine combustor according to claim 1, wherein said plurality of main nozzles are disposed upstream of the injection port of said pilot nozzle, and said secondary mixing chamber comprises an annular premixing nozzle having a throttled exit end adjacent said combustion chamber.

3. A gas turbine combustor according to claim 2, wherein each of said main nozzles includes at least first and second tubes, the first tube having an injection port within the primary mixing chamber wall such that gaseous fuel is fed through the first tube within the primary mixing chamber wall of said main nozzle, and the the second tube having an atomizer at the exit end of said annular premixing nozzle.

4. A gas turbine combustor according to claim 1, and further comprising vanes extending inwardly from the primary mixing chamber wall of each of said main nozzles.

5. A gas turbine combustor according to claim 2, and further comprising vanes extending inwardly from the primary mixing chamber wall of each of said main nozzles.

6. A gas turbine combustor according to claim 3, and further comprising vanes extending inwardly from the primary mixing chamber wall of each of said main nozzles.

* * * * *